United States Patent [19]

Hintsch et al.

[11] Patent Number: 4,497,346

[45] Date of Patent: Feb. 5, 1985

[54] CLUTCH ARRANGEMENT FOR CONTROLLING A HEDDLE OF A WEAVING MACHINE

[75] Inventors: Otto Hintsch; Werner Julich, both of Wallisellen, Switzerland

[73] Assignee: Sulzer Brothers Limited, Winterthur, Switzerland

[21] Appl. No.: 300,663

[22] Filed: Sep. 9, 1981

[30] Foreign Application Priority Data

Sep. 12, 1980 [EP] European Pat. Off. ..... 80 105440.4

[51] Int. Cl.[3] ..... D03C 1/00

[52] U.S. Cl. ..... 139/66 R; 139/76

[58] Field of Search ..... 139/76, 66 R, 68; 74/570, 571

[56] References Cited

U.S. PATENT DOCUMENTS

| | | | |
|---|---|---|---|
| 373,941 | 11/1887 | Norcross | 139/76 |
| 1,672,434 | 6/1928 | Staubli | 139/68 |
| 3,422,859 | 1/1969 | Malchair | 139/66 R |
| 3,730,232 | 5/1973 | Kleiner | 139/66 R |
| 4,172,476 | 10/1979 | Kleiner | 139/68 |
| 4,182,380 | 1/1980 | Palau | 139/68 |

FOREIGN PATENT DOCUMENTS

| | | | |
|---|---|---|---|
| 2741199 | 2/1979 | Fed. Rep. of Germany | 139/76 |
| 580183 | 7/1958 | Italy | 139/76 |
| 761628 | 9/1980 | U.S.S.R. | 139/76 |

*Primary Examiner*—Kenneth J. Dorner

*Attorney, Agent, or Firm*—Kenyon & Kenyon

[57] ABSTRACT

The clutch arrangement contains a stroke member which carries two levers and a spring connecting the levers. The stroke member is driven by a drive lever which engages between the two levers. The stroke member drives the bar for the control levers while a scanning arm is moved against the armature of an electromagnet. Both movements occur with a force transmission occuring via the single spring. This provides for especially gentle treatment of the parts. At the same time, relatively few parts are needed.

6 Claims, 3 Drawing Figures

1
2
3
4
5
6
7
8
9
11
12
13
14
15
16
17
18
21
22
23
24
25
26
27
28
31
32
33
34
35
36
37
38
41
42
44
45
46
47
48
51
52
53
54
55
60
61
63
65
66
69
70

CLUTCH ARRANGEMENT FOR CONTROLLING A HEDDLE OF A WEAVING MACHINE

This invention relates to a clutch arrangement for controlling a heddle of a weaving machine.

As is known, various types of arrangements have been used for controlling the operation of the heddles of a weaving machine such as a power loom. For example, as described in German A.S. No. 27 41 199 one known clutch arrangement utilizes an intermittently rotatable drive shaft having at least one slot, a pawl which can be engaged in the slot and which is disposed on an eccentric rotatably mounted on the drive shaft as well as a strap for a crank rod of a heddle drive which is disposed about the eccentric. In addition, at least one control lever is movable into the path of the pawl so as to disengage the pawl from the drive shaft. This control lever can be pivoted back and forth by means of a bar which is engagable in a stroke meter drive. In this known arrangement, the bar is spring loaded and is driven by a drive rod against the action of the spring. In this case, the bar is moved back under the action of the spring. This reciprocating movement may or may not be coupled with a stroke meter depending on whether or not the bar is released by an armature of an associated electro magnet.

This known clutch arrangement, however, is relatively complicated and requires several springs. Further, the drive parts strike in an unsprung manner against the bar to be coupled with the stroke meter or to be blocked by the armature.

Accordingly, it is an object of the invention to provide a clutch arrangement of relatively simple structure.

It is another object of the invention to provide a clutch arrangement for a heddle control which utilizes a minimum of springs.

It is another object of the invention to provide a clutch arrangement for controlling a heddle which can be operated in a gentle manner.

Briefly, the invention provides a cluth arrangement for controlling a heddle of a power loom. The clutch arrangement includes an intermittently rotatable drive shaft having at least one slot, an eccentric rotatably mounted on the shaft, a pawl mounted on the eccentric for engagement in the slot of the shaft and a strap for a crank rod of a heddle drive about the eccentric. In addition, the arrangement includes at least one control lever which is movable into the path of the pawl, a bar for moving the control lever back and forth, a stroke meter drive for engaging the bar in order to move the bar and a program control device for controlling operation of the pawl. Still further, the arrangement has a stroke member for selectively driving the bar in programmed response to the stroke member scanning the control device and a spring which is interposed between the stroke member and the bar in order to transmit forces therebetween.

The stroke member functions not only as a sprung scanning element for scanning the associated program control device but also as the spring-supported drive of the bar. Thus, only one spring is required in the clutch arrangement so that the bar can be held in a force-transmitting coupling position with the stroke meter and in a force-locking scanning position with the program control device. The various parts can therefore be brought into an operative position relative to each other under especially gentle conditions and can be held in this operative positon resiliently. Moreover, the arrangement can be constructed with relatively few parts.

These and other objects and advantages of the invention will become more apparent from the following detailed description taken in conjunction with the accompanying drawings wherein.

Figure 1:
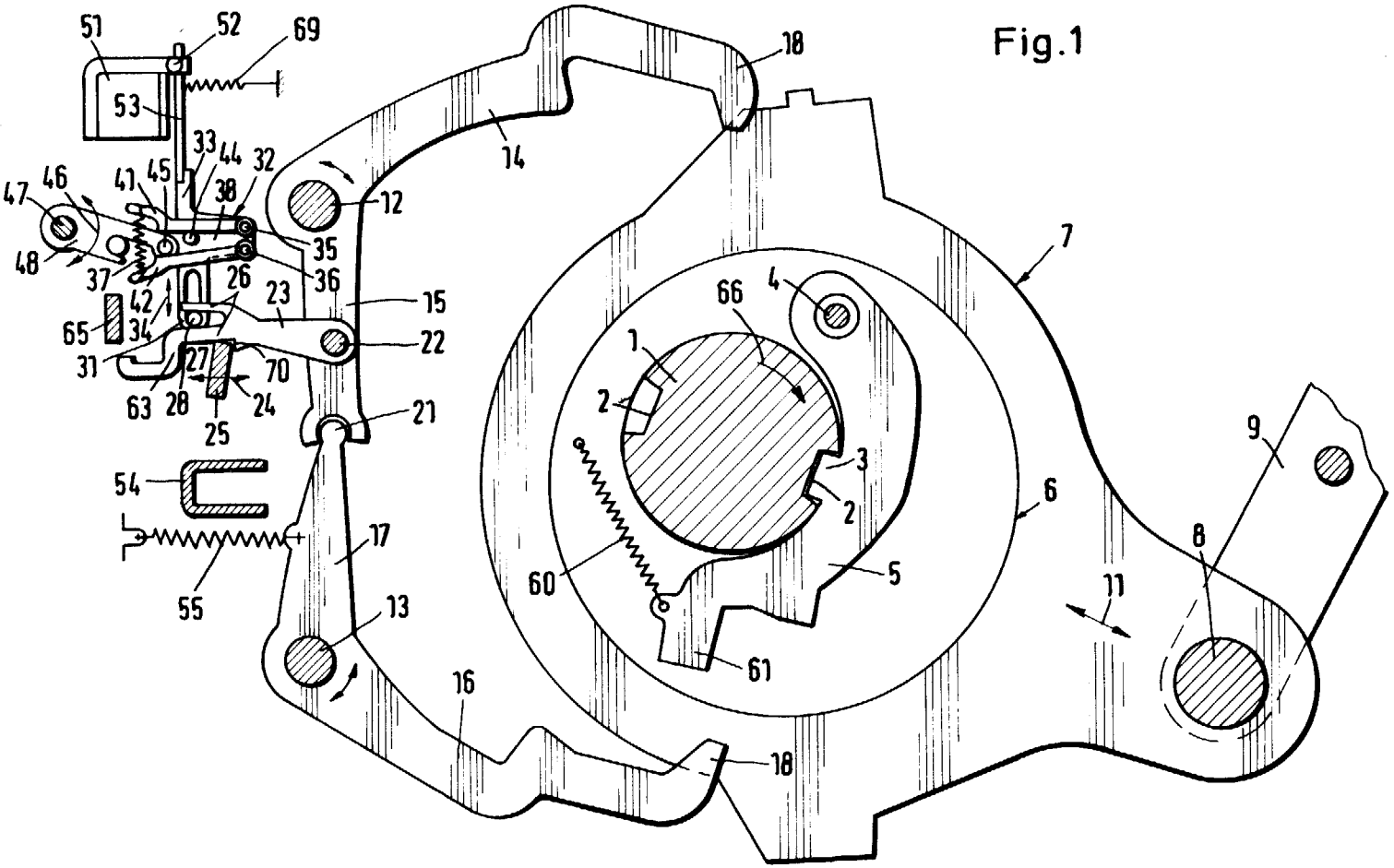
FIG. 1 illustrates a sectional view of a cluth arrangement according to the invention.

Referring to FIG. 1, the clutch arrangement is used for controlling a heddle (not shown) of a weaving machine, for example a power loom. As indicated, the clutch arrangement incorporates a drive shaft 1 which is intermittently rotatable in the direction indicated by the arrow 66 in increments of 180° off a main shaft (not shown) of the weaving machine. The drive shaft 1 includes a pair of diametrically opposed slots 2 for selectively receiving a nose 3 of a pawl 5 which is pivotally mounted by a suitable pivot 4 on an eccentric 6. The eccentric 6 is, in turn, rotatably mounted on the drive shaft 1 for purposes as described below. As shown, an extension spring 60 is secured to a free end of the pawl 5 and to the eccentric 6 so as to bias the pawl 5 towards the drive shaft 1.

In addition, a strap 7 for a crank rod (not shown) of a heddle drive is disposed about the eccentric 6. The strap 7 is articulated at a pivot point 8 to a transmission linkage 9 so as to transfer a reciprocating movement of the strap 7 which occurs in the direction indicated by the arrow 11 to the associated heddle of the loom.

Of note, the drive shaft 1 mounts a plurality, for example 6 to 12, of the drive parts 6, 7 for each heddle of the loom. Thus, the drive shaft 1, eccentrics 6 and straps 7 form the so-called eccentric machine for the drive and control of all heddles of the loom. The heddles are thus movable according to a weaving program for the warp threads in a high or low shed position.

In order to actuate the pawl 5 during operation, the clutch arrangement employs a pair of two-armed control levers 14, 15; 16, 17 which are pivotally mounted on fixed bearing pins 12, 13. As shown, each lever has a hook 18 at the free end which can be moved into the path of the pawl 5. In addition, the two control levers are connected via the arms 15, 17 in an articulated joint 21.

The clutch arrangement also has a bar 23 which is pivotally connected via a pin 22 to the arm 15 of one lever for moving the control levers between a blocking position and a release position (as shown). This bar 23 is, in turn, movable between an operative position as shown in FIG. 1 to cooperate with a stroke meter drive 25 and an inoperative position out of the influence of the stroke meter drive 25. As indicated in FIG. 1, the stroke meter drive 25 is movable in a back and forth direction as indicated by the arrow 24.

The bar 23 has a forked portion 26 forming a slot 27 as well as a bend 63 and a shoulder 70 for abutting the stroke meter drive 25.

A three-armed stroke member is mounted in a suitable manner so as to be moved up and down as indicated by the arrow 34. One arm 31 of this stroke member is slotted and carries a pin 28 which, in turn, fits into the slot 27 of the bar 23. A second arm 32 carries a pair of levers 41, 42 (overload levers). These levers 41, 42 are pivotally mounted via pivots 35, 36 at one end and are biased towards each other by a spring 37. The levers 41, 42 and spring 37 form a so-called center spring support. In addition, the levers 41, 42 form a slot 38 within which a pin 44 mounted on the stroke member is disposed. The third arm 33 acts as a scanning arm for purposes as described below.

As shown in FIG. 1, a drive lever 48 is pivotally mounted about a fixed pin 47 to pivot in the direction indicated by the arrow 46 in order to impart motion to the stroke member 31, 32, 33. This drive lever 48 carries a pin 45 which extends into the slot 38 between the levers 41, 42. During operation, the drive lever 48 executes a complete up and down stroke while the drive shaft 1 rotates only by 180° (double stroke method).

A program control device for controlling the operation of the pawl 5 is disposed above the scanning arm 33 of the stroke member. As indicated, the program control device is formed by a fixed electro-magnet 51 and an armature 53 which is pivotable about a pivot 52. The electromagnet 51 functions to attract the armature 52 thereto against the biasing force of a spring 69. As indicated, the spring 69 is fixed to a fixed point within the machine and to the armature 53 to pivot the armature 53 away from the electro-magnet 51.

A fixed stop 54 is provided to limit the swinging movement of the control levers 14, 15; 16, 17. As indicated the stop 54 is disposed in the path of the arm 17 and an extension spring 55 is secured to the arm 17 and to a fixed point in the machine to bias the arm 17 against the stop 54. A stop 65 is also mounted in a suitable member to limit the upward movement of the bar 23 by abutting against a nose 72 (see FIG. 3) of the bar 23.

In operation, when a heddle associated with the strap (rocker arm) 7 is to be moved up and down, the pawl 5 must remain engaged in the drive shaft 1 as illustrated in FIG. 1. For this purpose, the control levers 14–17 must be in the inoperative position shown in FIG. 1 when the free end 61 of the pawl 5 passes under one of the hooks 18 of the control levers 14–17. During this time, the drive lever 48 initially moved downwardly causing the pin 45 to strike against the lower (as viewed) overload lever 42. Thus, the stroke member 31–33 is moved downward a relatively small distance (narrowest position) of the overload levers 41, 42). As the pin 28 on the stroke member also descends, the bar 23 is pivoted downwardly so as to engage with the stroke meter drive 25. In the last phase of the downward movement of the drive lever 48, the lower lever 42 continues to move so that the tension of the spring 37 is somewhat increased. Thus, the stroke member 31, 32, 33 is biased against the bar and the bar 23 is biased against the stroke meter drive 25 for the transmission of force.

Each time the free end 61 of the pawl 5 passes under one the hooks 18, the stroke meter drive 25 and bar 23 are in the position shown in FIG. 1. In this position, the arms 15, 17 of the control levers are moved to the right, as viewed, and the hooks 18 are swung into the release position shown.

Because the spring 37 is further tensioned at the end of the downward stroke of the drive lever 48, the stroke of the lever 48 need not be adapted exactly to the stroke movement of the stroke member 31–33. That is, the drive lever 48 executes a certain overstroke.

Figure 2:
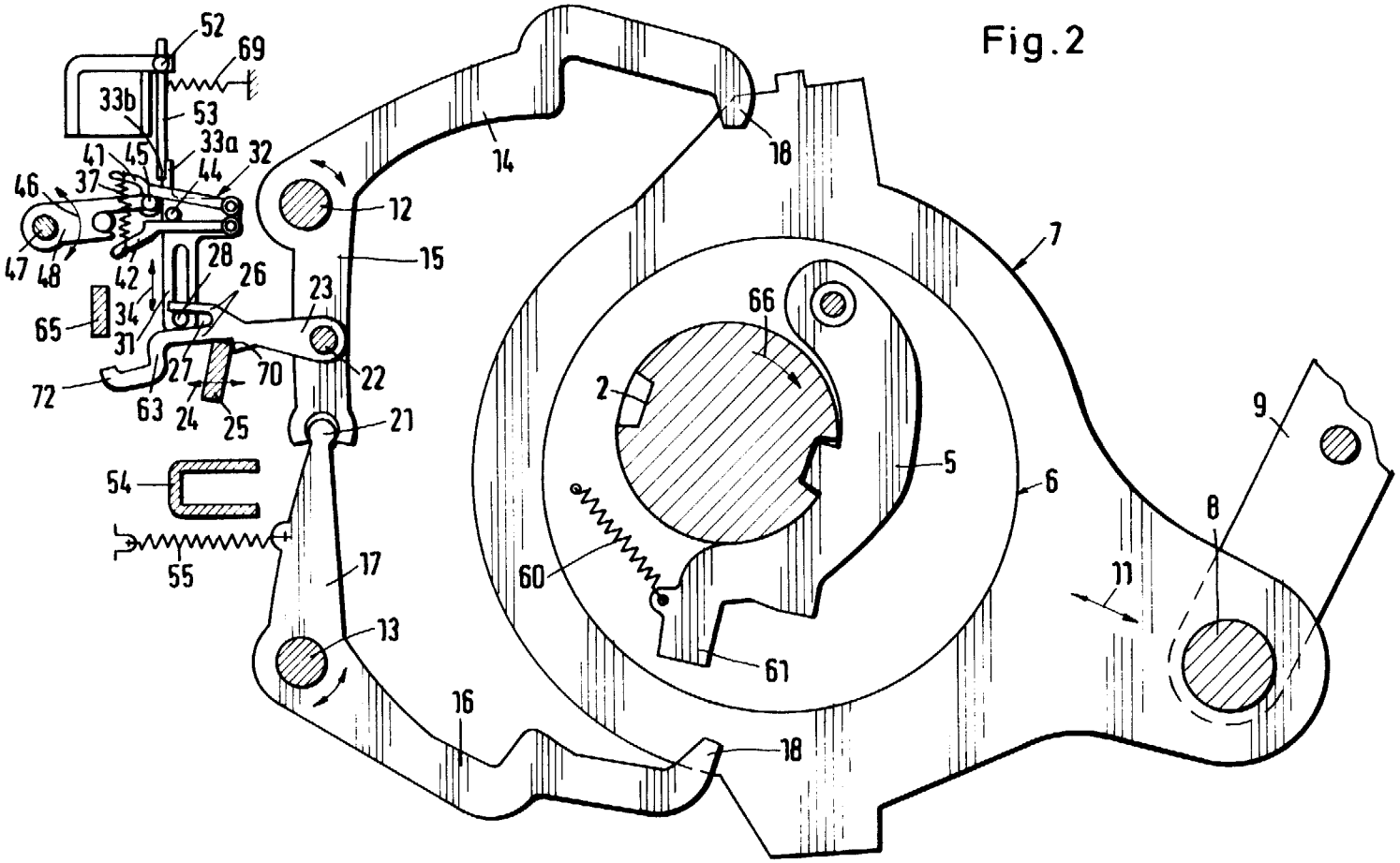
FIG. 2 illustrates a view similar to FIG. 1 of the clutch arrangement in an operative position.

If, as is assumed, the heddle driven by the rocker arm 7 is to continue to move alternately into the high and low shed positions, the armature 53 must not be attracted by the electromagnet 51 but must remain in the blocking position shown in FIGS. 1 and 2. At this time, the magnet 51 receives no current from the respective voltage source (not shown) and remains unenergized.

Subsequently, the stroke meter drive 25 is moved to the left, as viewed in FIG. 1 until the arm 17 strikes against the stop 54. The stroke member drive 25 is then moved into the left reversal position in which the drive 25 lifts off the shoulder 70 of the bar 23. The drive lever 48 is then moved upward as viewed in FIG. 1. At this time, the pin 45 moves into abutment with the upper lever 41 with the lower lever 42 following under the action of the relaxing spring 37. The levers 41, 42 then take up the position in which they are closest to each other. When the pin 45 is moved farther upwardly, both levers 41, 42 and the stroke member 31–33 follow upwardly at first. However, the scanning arm 33 immediately moves into the blocking position **33*a* as shown in FIG. 2 in which a shoulder 33*b* thereof strikes against the armature 53. Upon further upward movement of the stroke member, the pin 45 is pushed against the lever 41 so that the lever 41 is swung into the upper position as shown in FIG. 2. At this time, the spring 37 stretches so that the distance between the levers 41, 42** is increased.

When in the position shown in FIG. 2, the energy generated by the drive lever 48 is transmitted via the spring 37 to the lower lever 42 and thence via the pin 44 to the stroke member so that the member is held under a spring action in the locking position shown in FIG. 2. Hence, the scanning arm 33 is resiliently biased in a force-transmitting abuttment against the armature 53.

Thereafter, the stroke meter drive 25 reaches the right-hand position shown in FIG. 2. At this time, the control levers 14–17 are in the swung-out release position and the pawl 5 remains engaged.

If a heddle is to remain in a high shed position or in the low shed position which has been reached, the associated pawl 5 must be disengaged. This takes place as follows.

The stroke meter drive 25 moves from the right-hand position shown in FIG. 1 to the left until reaching the left reversal position. At this point, there is some play between the stroke meter drive 25 and the bend 63 of the bar 23. The bar 23 is also moved to the left until movement is limited by the stop 54 via the arms 17, 15. The levers 14–17 thus take up the locking position shown in FIG. 3. At the same time, the electromagnet 51 is energized so that the armature 53 is swung to the left inactive position **53*a* as shown in FIG. 3**.

Figure 3:
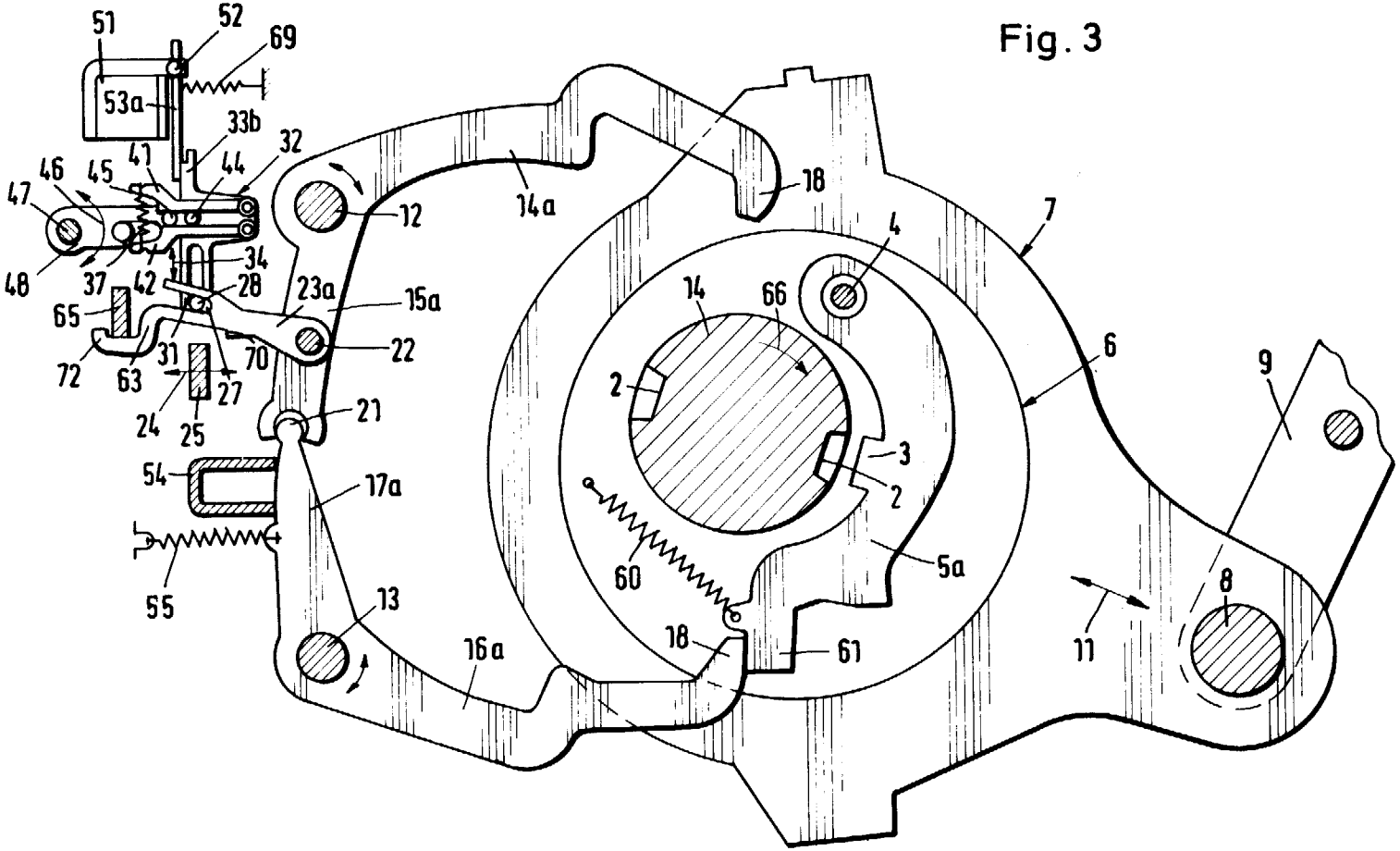
FIG. 3 illustrates a view of the clutch arrangement in an inoperative position.

With the following upward movement of the drive lever 48, the stroke member 31–33 is moved to the upper position shown in FIG. 3 while maintaining the least distance between the levers 41, 42. The scanning arm 33 now takes up the position **33*b* which is made possible by the inactive position 53*a* of the armature 53. In this position, the arm 33 stands next to the armature 53. With the upward movement of the stroke member 31–33, the movement generated by the drive lever 48 or, respectively, the drive force, is transmitted via the pin 45 to the lever 41 and from there the energy is transmitted via the spring 37 to the trailing lever 42. The lever 42, in turn, moves the stroke member 31—33 upwardly via the pin 44**.

At the same time, the pin 28 on the stroke member is moved upwardly. The bar 23 is thereby brought into the upper inactive position **23*a* of FIG. 3 in which the bar 23 is out of engagement with the stroke meter drive. As indicated, the nose 72 of the bar 23 is abutted against the stop 65 with some play. This stop 65 thus limits the upward movement of the bar 23 and together with the nose 72 prevents the control levers 14–17 from pivoting out of the blocking position (FIG. 3**) unintentionally.

Upon rotation of the drive shaft 1 in the direction indicated by the arrow 66, the free end 61 of the engaged pawl 5 runs against the hook 18 of the swung-in control lever 16, 17. As a result, the pawl 5 is pivoted into the disengaged position 5*a* as shown in FIG. 3 in which the nose 3 is outside of the slot 2. The respective heddle thus remains, together with the pawl 5, in the high or low shed position last obtained.

During the following downward movement of the drive lever 48, stroke member 31–33 and bar 23, the bar 23 temporarily comes into the sphere of action of the stroke meter drive 25. However, the bar 23 is immediately moved back again into the disengaged position 23*a* shown in FIG. 3 by the subsequently re-ascending drive lever 48, the position of the armature 53*a* being the same. Thus, the stroke meter drive 25 is unable to move the bar 23 to the right as shown in FIG. 3 and to bring the control levers 14–17 into the release position. The pawl 5 and respective heddle thus remain in the inactive position as before.

If the heddle is to be moved to another position, the electromagnet 51 is deenergized. Thus, with the next downward movement of the drive lever 48, stroke member 31–33 and bar 23, the armature 53 is moved to the blocking position as shown in FIG. 1 under the action of the spring 69. With the next upward movement of the drive lever 48, the cycle described above for FIGS. 1 and 2 repeats. At this time, the arm 33 reaches the blocking position 33*a* (FIG. 2), the bar 23 remains in the engaged position and is again moved to the right by the stroke meter 25 and the control levers 14–17 are swung out into the release position (FIG. 1). Due to the action of the spring 60, the pawl 5 again engages in the drive shaft 1 so as to again be taken along with the drive shaft 1. The respective heddle is thus set in motion again and reaches the other shed position.

During an up and down movement, the stroke member 31–33 and the levers 41–42 are taken along by the pin 45 with the least distance between the levers 41, 42 being maintained by the spring 37 so long as there is no obstacle in the movement path. Thus, the spring 37 remains ready for over tension as soon as the up and down movement of these parts is blocked or limited, for instance by the armature 53 or by the stroke meter drive 25. Thus, one and the same spring 37 is used for force transmitting entrainment during the up and down movement of the parts. It is of significance that the spring 37, rather than being fastened to a stationary part is moved along with the stroke member 31–33 by being attached to the two levers 41, 42.

The invention thus provides a clutch arrangement which requires relatively few parts. Further, due to the relatively small number of control parts such as the stroke member 31–33, spring 37 and bar 23 to be moved, these parts may be of relatively small mass. Thus, the control movements can be effected with especially high acceleration. This is advantageous in order to obtain a high machine speed. In addition, upon disengaging the pawl 5, it is not necessary to overcome by movements and forces on the part of the members 31–33, 37, 23, the relatively high force of the spring 60 which holds the pawl 5 in the engaged position with the shaft 1. Instead, these members have only a selection function.

What is claimed is:

1. A clutch arrangement for controlling a heddle of a power loom, said arrangement comprising an intermittently rotatable drive shaft having at least one slot therein;

an eccentric rotatably mounted on said shaft;

a pawl mounted on said eccentric for engagement in said slot of said shaft;

at least one control lever movable into the path of said pawl;

a bar connected to said control lever for moving said control lever back and forth;

a stroke meter drive for engaging said bar to move said bar;

a program control device for controlling operation of said pawl;

a stroke member for selectively driving said bar in programmed response to said stroke member scanning said control device;

a drive lever for imparting motion to said stroke member; and a spring interposed between said drive lever and said stroke member for biasing said stroke member against said bar to transmit forces therebetween.

2. A clutch arrangement as set forth in claim 1 which further comprises a pin mounted on said stroke member, a pair of levers pivotally mounted on said stroke member with said pin therebetween and with said spring biasing said levers towards each other, and a pin on said drive lever disposed between said levers for imparting motion to said stroke member.

3. A clutch arrangement as set forth in claim 2 wherein said control device includes an electromagnet having a pivotal armature for selectively abutting a scanning end of said stroke member.

4. In a clutch arrangement for controlling a heddle of a weaving machine, the combination comprising a control lever mounted for movement between a blocking position and a release position;

a bar for moving said control lever between said positions;

a reciprocal stroke member for moving said bar between an operative position and an inoperative position;

a drive lever for reciprocating said stroke member and a spring interposed between said drive lever and said stroke member for transmitting forces therebetween.

5. The combination as set forth in claim 4 which further comprises a pin mounted on said stroke member, a pair of levers pivotally mounted on said stroke member with said pin therebetween and with said spring biasing said levers towards each other, and a pin on said drive lever disposed between said levers for imparting motion to said stroke member.

6. In a clutch arrangement for controlling a heddle of a weaving machine, the combination comprising a control lever mounted for movement between a blocking position and a release position;

a bar for moving said control lever between said positions;

a reciprocal stroke member for moving said bar between an operative position and an inoperative position;

a pin mounted on said stroke member;

a pair of levers pivotally mounted on said stroke member with said pin therebetween;

a spring biasing said levers towards each other, and a drive for reciprocating said stroke member having a pin disposed between said levers for imparting motion to said stroke member.

* * * * *

UNITED STATES PATENT AND TRADEMARK OFFICE

CERTIFICATE OF CORRECTION

PATENT NO. : 4,497,346

DATED : February 5, 1985

INVENTOR(S) : Otto Hintsch and Werner Julich

It is certified that error appears in the above-identified patent and that said Letters Patent is hereby corrected as shown below:

Column 3, line 44 after "tion" delete --)--

Column 3, line 51 after "bar" insert --23--

Signed and Sealed this

*Eleventh* Day of *June 1985*

[SEAL]

*Attest:*

DONALD J. QUIGG

*Attesting Officer* *Acting Commissioner of Patents and Trademarks*